US009074475B2

(12) United States Patent
Raubacher et al.

(10) Patent No.: US 9,074,475 B2
(45) Date of Patent: Jul. 7, 2015

(54) SEALING ELEMENT FOR A ROTARY PISTON MACHINE

(71) Applicant: Heinz Raubacher, Valhingen (DE)

(72) Inventors: Heinz Raubacher, Valhingen (DE); Uwe Koch, Pliezhausen (DE); Marko Voigt, Ludwigsburg (DE); Markus Alber, Steinheim (DE)

(73) Assignee: Heinz Raubacher, Valhingen (DE)

( * ) Notice: Subject to any disclaimer, the term of this patent is extended or adjusted under 35 U.S.C. 154(b) by 0 days.

(21) Appl. No.: 13/961,333

(22) Filed: Aug. 7, 2013

(65) Prior Publication Data

US 2013/0319222 A1 Dec. 5, 2013

Related U.S. Application Data

(63) Continuation of application No. PCT/EP2012/051076, filed on Jan. 25, 2012.

(30) Foreign Application Priority Data

Feb. 10, 2011 (DE) ..... 10 2011 003 934

(51) Int. Cl.

| | |
|---|---|
| ***F01C 19/00*** | (2006.01) |
| ***F03C 2/00*** | (2006.01) |
| ***F03C 4/00*** | (2006.01) |
| ***F04C 2/00*** | (2006.01) |
| ***F01B 31/00*** | (2006.01) |
| ***F04C 27/00*** | (2006.01) |
| ***F04C 15/00*** | (2006.01) |

(Continued)

(52) U.S. Cl.

CPC ..... *F01B 31/00* (2013.01); *F04C 27/009* (2013.01); *F05C 2225/00* (2013.01); *F05C 2225/04* (2013.01); *F01C 19/005* (2013.01); *F04C 15/003* (2013.01); *F04C 15/0038* (2013.01); *F01C 1/063* (2013.01); *F01C 9/002* (2013.01); *F01C 19/10* (2013.01)

(58) Field of Classification Search

USPC ..... 418/104, 152–153, 223, 225; 277/560, 277/562, 565, 570, 577, 944

See application file for complete search history.

(56) References Cited

U.S. PATENT DOCUMENTS

| | | | |
|---|---|---|---|
| 1,328,410 | A | 1/1920 | Weed |
| 1,476,784 | A | 12/1923 | Weed |

(Continued)

FOREIGN PATENT DOCUMENTS

| | | | |
|---|---|---|---|
| DE | 43 33 047 | | 10/1994 |
| DE | 102007001021 | A1 * | 7/2008 |

(Continued)

*Primary Examiner* — Theresa Trieu

(74) *Attorney, Agent, or Firm* — Womble Carlyle Sandridge & Rice, LLP

(57) ABSTRACT

A sealing element for a rotary piston machine for sealing a lever is provided which is guided in an annular gap and is rotatable around a rotational axis, wherein the sealing element is rotationally symmetrical relative to the rotational axis, characterized in that the sealing element comprises a dynamic region and a static region, wherein the dynamic region has an axial sealing face being directed towards the annular gap, and a radial sealing face being directed towards the interior of an annular channel of the rotary piston machine, which annular channel surrounds the annular gap; and wherein the static region serves to fix the sealing element to the rotary piston machine, and wherein there is formed in the static region a channel, to which a fluid can be supplied.

17 Claims, 3 Drawing Sheets

(51) Int. Cl.

| | |
|---|---|
| ***F01C 19/10*** | (2006.01) |
| *F01C 1/063* | (2006.01) |
| *F01C 9/00* | (2006.01) |

(56) References Cited

U.S. PATENT DOCUMENTS

| | | | | |
|---|---|---|---|---|
| 1,944,875 | A | 1/1934 | Bullington | |
| 2,997,318 | A * | 8/1961 | Lansky et al. | 277/565 |
| 3,829,106 | A * | 8/1974 | Wheelock | 277/570 |
| 4,560,174 | A | 12/1985 | Bisi | |
| 5,055,015 | A * | 10/1991 | Furukawa | 418/104 |
| 6,737,165 | B1 | 5/2004 | Smith et al. | |
| 2006/0145426 | A1 * | 7/2006 | Schroeder et al. | 277/560 |
| 2008/0010827 | A1 | 1/2008 | Hatch | |
| 2010/0071545 | A1 | 3/2010 | Raubacher | |

FOREIGN PATENT DOCUMENTS

| | | |
|---|---|---|
| EP | 1 263 877 | 6/2007 |
| GB | 591 781 | 8/1947 |

* cited by examiner

SEALING ELEMENT FOR A ROTARY PISTON MACHINE

CROSS-REFERENCE TO RELATED APPLICATIONS

The present application is a continuation of international application number PCT/EP2012/051076, filed on Jan. 25, 2012, which claims priority to German patent application number 10 2011 003 934.1, filed Feb. 10, 2011, the entire specification of both being incorporated herein by reference.

FIELD OF THE INVENTION

The present invention relates to a sealing element for a rotary piston machine for sealing a lever which is guided in an annular gap and is rotatable around a rotational axis, wherein the sealing element is rotationally symmetrical relative to the rotational axis.

BACKGROUND OF THE INVENTION

A rotary piston machine is described, for example, in DE 10 2007 001 021 A1. This comprises an annular channel, which is curved along an at least partial arc of a circle, and in which a piston can be caused to perform a movement along the arc by subjecting it to pressure with a fluid. This movement is transmitted by means of a lever connected to the piston to a rotary body, which has a rotational axis coaxial with the annular channel. Therefore, with the rotary piston machine a torque can be generated directly by hydraulic forces in contrast to a conventional hydraulic piston, which generates a linear force.

In the case of such a rotary piston machine the lever is configured as a substantially circular drive disc, which rotates around the rotational axis with the piston and the edge region of which is guided in an annular gap in the wall of the annular channel. According to principle, this annular gap must extend over the entire length of the arc, which should be available for a movement of the piston, i.e. in an extreme case along the entire periphery of a circle. This sets high demands on the necessary sealing of the annular channel against discharge of the hydraulic fluid between the walls of the annular channel and the lever. In this case, tightness must be assured both in the static state (stoppage of the piston and the lever) and in the dynamic state (movement of the piston and the lever) as well as at different pressures of the hydraulic fluid, which can typically be up to approximately 150 bar.

It is an object of the present invention to propose a sealing element for such a rotary piston machine, with which these demands can be met to a high degree.

SUMMARY OF THE INVENTION

This object is achieved according to the invention with the sealing element of the aforementioned type in that the sealing element comprises a dynamic region and a static region,

- wherein the dynamic region has an axial sealing face being directed towards the annular gap, and a radial sealing face being directed towards the interior of an annular channel of the rotary piston machine, which annular channel surrounds the annular gap; and
- wherein the static region serves to fix the sealing element to the rotary piston machine, and wherein a channel, to which a fluid can be supplied, is formed in the static region.

For sealing the lever of a rotary piston machine two sealing elements according to the invention are respectively provided, which are arranged on opposite sides of the annular gap and their axial sealing faces abut against opposing surfaces of the disc-like lever. The sealing elements are fixed to the rotary piston machine by being seated, for example, in corresponding recesses of the wall of the annular channel.

In the case of the sealing element according to the invention the dynamic region, along the axial and radial sealing face of which the lever or the piston slide during operation of the rotary piston machine, must assume the task of sealing against the hydraulic fluid. The contact pressure or surface pressure between the sealing faces and the movable parts must therefore be at least as high as the pressure of the hydraulic fluid on the side of the piston subjected to pressure (system pressure). However, conversely, the contact pressure should not be too high to prevent unnecessary friction losses.

The thus necessary variation of contact pressure is effected according to the invention in that the channel formed in the static region of the sealing element is supplied with the pressurised hydraulic fluid. This supply therefore occurs from the static side (by means of corresponding supply pipes for the hydraulic fluid), wherein the pressure in the channel is transferred from the static region to the dynamic region of the sealing element and a counter-pressure acting on the sealing faces is thus generated. In this way, the contact pressure of the sealing element increases in keeping with the pressure of the hydraulic fluid in the annular channel, against which the sealing should occur. The sealing effect of the sealing element according to the invention—when the channel is supplied with the hydraulic fluid—is therefore more or less self-regulating.

By an appropriate design of the geometry of the sealing element and also selection of the materials used, which will be explained in more detail below, the self-regulating effect upon supply of the channel with the hydraulic fluid can be adjusted such that both in the static and in the dynamic state a sufficient contact pressure, e.g. a surface pressure, respectively exists that lies about 10% above the system pressure.

The dynamic region and the static region of the sealing element can be made from the same material. In this case, the sealing element can be formed in one piece in particular. Fluoropolymers such as PTFE or TFE copolymers in particular are possible as suitable materials in this case.

In a particularly preferred embodiment of the invention the sealing element comprises a first sealing part, which forms the dynamic region, and a second sealing part, which forms the static region. In this case, the second sealing part is connected to the first sealing part along its sides opposite the sealing faces. Such a two-part configuration of the sealing element enables the use of different materials for the dynamic and the static region, so that the properties of the two regions are optimised substantially independently of one another and a particularly advantageous separation of function is made possible.

The first and the second sealing part are respectively rotationally symmetrical in relation to the rotational axis, i.e., the sealing element respectively has substantially the same cross-sectional form along different planes containing the rotational axis. In keeping with the annular channel of the rotary piston machine the sealing element can extend along the entire periphery of a circle, i.e., be configured in a ring shape, or only along a partial arc of a circle.

In the two-part configuration of the sealing element according to the invention the direct dynamic sealing function is assumed by the first sealing part. This is preferably formed from a non-elastomeric fluoropolymer. Fluoropolymers, in particular PTFE or TFE copolymers (see below), are distinguished by a high abrasion resistance, a high chemical and thermal resistance and a low friction resistance. The latter property is of essential importance, since the axial sealing face of the first sealing part extends in peripheral direction over the entire extent of the lever and is therefore relatively large. Too high a friction would lead to considerable losses in the case of force transmission and also to a heavy wear of the lever.

Non-elastomeric fluoropolymers in particular also have a low friction force variation, i.e. the static friction and the sliding friction are approximately equal or only differ insignificantly. An undesirable stick-slip effect, i.e., a sudden setting in motion of the piston, can be substantially avoided as a result of this.

Besides the axial sealing face, which completely or partially abuts against the surface of the lever and thus assumes the substantial part of the sealing of the annular channel to the outside, the dynamic region or the first sealing part of the sealing element according to the invention also has a radial sealing face, which completes this sealing. In this case, the radial sealing face forms a part of the peripheral face of the annular channel and abuts respectively in sections against the piston, which moves along the annular channel. In this section the radial face thus (besides the sealing of the piston) assists in the sealing of the side of the piston subjected to pressure opposite the side not subjected to pressure.

The axial sealing face and the radial sealing face meet one another along an edge, which is circular or in the form of a partial arc of a circle. This edge runs along the outer periphery of the lever.

In a two-part sealing element according to the invention the second sealing part is preferably formed from an elastomeric material. As a result of this, a certain prestress is achieved, i.e., the first sealing part is pressed against the lever as a result of the elastic properties of the second sealing part. This contact pressure is sufficient at least for the static state of the rotary piston machine, i.e. for the case where the piston is not in motion and the fluid causing motion is not subjected to pressure or is only subjected to a low pressure.

The axial sealing face of the dynamic region or the first sealing part can lie in a plane perpendicular to the rotational axis. In this case, already in the static state (i.e., without pressure supply to the channel) the entire axial sealing face abuts against the surface of the lever, which is likewise perpendicular to the rotational axis. However, such a large effective sealing surface is often not necessary in the static case.

Therefore, it is preferred if the axial sealing face is inclined in relation to a plane perpendicular to the rotational axis. In the static, i.e. pressureless, state the axial sealing face then only abuts against the surface of the lever in the region of the edge between the axial and the radial sealing face. In the dynamic state the dynamic region is deformed slightly by the supply of hydraulic fluid to the channel and the inclined axial sealing face is pressed in the direction of the lever, i.e. the effective sealing surface is continuously increased with increasing hydraulic pressure until the entire axial sealing face abuts against the lever.

The inclination of the axial sealing face advantageously amounts to not more than 8°, wherein an inclination in the range of 1° to 3° is particularly preferred. The choice of the appropriate angle of inclination is also dependent, inter alia, on the selected material (e.g., on the type of non-elastomeric fluoropolymer of the first sealing part).

It is favorable if the axial sealing face has one or more grooves. As a result of this, the effective sealing surface can be decreased or divided over a larger region in radial direction, which is advantageous in particular to adapt the extent of the axial sealing face to the geometry of the channel formed in the static region. The grooves can be arranged concentrically around the rotational axis or have a twist in order to direct hydraulic fluid that has penetrated between the sealing face and the lever back in the direction of the annular channel by rotation of the lever. The grooves can additionally serve as a reservoir for a lubricant (e.g., lubricating grease), which is applied to the sealing face.

As already mentioned above, the non-elastomeric fluoropolymer of the first sealing part (or a single-part sealing element) preferably consists of a homopolymeric PTFE or a copolymer of tetrafluoroethylene with at least one comonomer. The at least one comonomer is preferably selected from hexafluoropropylene, perfluoroalkyl vinyl ethers, perfluoro (2,2-dimethyl-1,3-dioxole) and chlorotrifluoroethylene.

Homopolymeric PTFE is distinguished by an extremely high thermal and chemical stability and also by a very low coefficient of friction, and therefore can be advantageously used within the framework of the present invention. However, PTFE, although it is a thermoplastic polymer, is not melt processable, i.e. by means of injection molding, for example, because of its extremely high melt viscosity. A first sealing part made of PTFE can be produced in particular by machining (e.g. turning).

Copolymers of tetrafluoroethylene and the aforementioned fluorine compounds in the case of a relatively low comonomer content are referred to as modified PTFE, which is likewise not melt processable. However, with a slight increase in the comonomer content fluoropolymers can be obtained that are melt processable, and the advantageous properties of the PTFE are almost fully retained. Such copolymers are described, for example, in EP 1 263 877 B1. A first sealing part made of such a material can be produced by injection molding, for example, which is more efficient in terms of production technique than machining.

A melt processable TFE copolymer with a melting point in the range of 315 to 324° C. is available from ElringKlinger Kunststofftechnik GmbH under the trademark Moldflon®.

The fluoropolymer can additionally contain one or more fillers. The properties of fluoropolymers, in particular stability under pressure and wear resistance, can be further improved by such fillers. Suitable fillers are known from the prior art and include e.g., graphite, carbon fibres, molybdenum sulphide and high-performance thermoplastics such as e.g. polyetherketones, polyphenylene sulphides, polyetherimides etc. The selection of type and quantity of the fillers is also dependent in particular on the type of fluoropolymer used.

In the case of a two-part sealing element the elastomeric material of the second sealing part preferably comprises a thermoplastic elastomer, in particular an elastomeric polyurethane. This possesses a series of properties, which render it particularly suitable for use within the framework of the present invention. Elastomeric polyurethane has sufficient elasticity to generate the necessary prestress of the sealing element in the static state, while at the same time being hard enough to be machined. Alternatively, the thermoplastic property enables the second sealing part to be produced by means of injection molding, for example. In addition, the elastomeric polyurethane has a high chemical resistance, compressive strength and wear resistance.

Alternatively to elastomeric polyurethane or other thermoplastic elastomers, other typically non-thermoplastic elastomers with a sufficient chemical resistance to the hydraulic fluid such as e.g. fluororubber, nitrile rubber, silicone rubber or EPDM can also be used, in principle, within the framework of the invention for the second sealing part.

The first and the second sealing part of the sealing element according to the invention can be connected to one another in different ways, e.g., by shape- or force-locking. However, the two sealing parts are preferably connected to one another in material-uniting manner. A material-uniting connection ensures a lasting stability of the sealing element and also as optimal as possible a force transmission between the first and the second sealing part, in particular also when hydraulic fluid is supplied to the channel of the second sealing part.

The two sealing parts can be adhered to one another, for example, by means of a suitable adhesive or adhesion promoter. However, in the case of the fluoropolymers of the first sealing part an initial surface treatment, e.g., by means of plasma etching or by means of sodium ammonia etching, is frequently necessary for this.

It is particularly favorable if the second sealing part is fused onto the first sealing part. This requires corresponding thermoplastic properties of the material of the second sealing part, such as those present in elastomeric polyurethane, for example. An additional adhesive can be omitted in this case.

A further advantageous possibility is that the first and second sealing parts are produced by co-extrusion of the non-elastomeric fluoropolymer and the elastomeric material. This requires that both materials are thermoplastically processable, which is the case in particular when using a thermoplastic TFE copolymer for the first sealing part. The production of such a sealing element is particularly efficient, since neither of the two sealing parts has to be produced by machining (e.g., turning).

As already described, the channel formed in the static region or in the second sealing part is able to increase the contact pressure of the axial sealing face on the surface of the lever as a result of the introduction of the pressurised hydraulic fluid into the channel. Depending on the configuration of the channel, this also applies, albeit mostly to a lesser degree, to the contact pressure of the radial sealing face (or a section of the radial sealing face) on the piston. In keeping with the rotational symmetry of the sealing element—the channel runs in the peripheral direction thereof, and the fluid is advantageously supplied by means of one or more fluid supply pipes in the wall of the annular channel of the rotary piston machine, which terminate in the recess that receives the sealing element.

In a preferred embodiment of the invention with a two-part sealing element, the channel is closed towards the first sealing part. Therefore, in this variant the fluid fed into the channel does not come into contact with the first sealing part, instead the force transmission occurs by means of a region of the elastomer material of the second sealing part.

As a result of this structure the channel can be open to the outside along the entire periphery of the sealing element without the second sealing part losing its structural integrity. In this case, the second sealing part can be produced both by injection molding and by machining (e.g., turning).

The channel formed in the second sealing part can be undercut, i.e., such that the base region of the channel widens in the direction of the radial sealing face of the first sealing part. As a result, the thickness of the elastic material between the channel and the first sealing part decreases in the radial direction and the contact pressure of the radial sealing face is increased as a result of the channel being subjected to pressure. This effect can be varied over a wide region and adapted to the respective requirements as a result of the configuration of the geometry of the channel or the sealing element overall.

According to a further advantageous embodiment of the invention the channel formed in the second sealing part is open towards the first sealing part. In this case, the hydraulic fluid fed into the channel comes directly into contact with the first sealing part, i.e. in particular with a region of the first sealing part having the axial sealing face, so that the force transmission is particularly effective. In this case, however, the channel cannot be open to the outside along the entire periphery of the sealing element, since otherwise the second sealing part would lose its structural integrity. Therefore, one or more openings (e.g., bores), which preferably run in the axial direction through the second sealing part and terminate in the channel, are provided in the second sealing part for introduction of the fluid into the channel.

In the case of a channel that is open towards the first sealing part, it is favorable if the channel is delimited by a metal profile, which is trough-shaped in cross-section and is open towards the first sealing part. The metal profile is preferably a steel profile. As a result of such a profile the cross-sectional shape of the channel can be stabilised, in particular against a deformation of the elastic material of the second sealing part as a result of the pressurised fluid. Moreover, impairment of the geometry of the channel can be prevented as a result of the metal profile, if the second sealing part formed from a thermoplastic elastomer is fused onto the first sealing part.

As already mentioned above, the sealing element according to the invention is suitable in particular for use in a rotary piston machine such as that described, for example, in document DE 10 2007 001 021 A1.

Therefore, the present invention also relates to a rotary piston machine with at least one annular channel, which is curved along an at least partial arc of a circle and in which a piston is movably disposed, and with an annular gap being incorporated into the wall of the annular channel in which a lever is guided, which is rotatable around a rotational axis coaxial to the annular channel, wherein the rotary piston machine comprises at least two sealing elements according to the invention, which are received in corresponding recesses of the wall of the annular channel, so that the axial sealing faces of the two sealing elements are respectively oriented towards opposite surfaces of the lever, and the radial sealing faces of the sealing elements are oriented towards the interior of the annular channel, and a section of the radial sealing faces abuts against the piston.

The advantages of the rotary piston machine according to the invention have already been explained in association with the sealing element according to the invention.

The sealing elements are held in the recesses of the wall of the annular channel in shape-locking and/or form-locking manner. It is particularly favorable if the sealing elements are adhered into the recesses, since a particularly stable connection can be created in this way. The adhesion provides in particular a fixture of the sealing elements against rotation relative to the wall. In this case, polyurethane adhesive is preferably used, in particular if the second sealing part is formed from an elastomeric polyurethane.

Further preferred embodiments of the rotary piston machine have already been explained in association with the sealing element according to the invention.

BRIEF DESCRIPTION OF THE DRAWINGS

These and further advantages of the invention are described in more detail on the basis of the following exemplary embodiments with reference to the Figures, wherein.

DETAILED DESCRIPTION OF THE INVENTION

Figure 1:
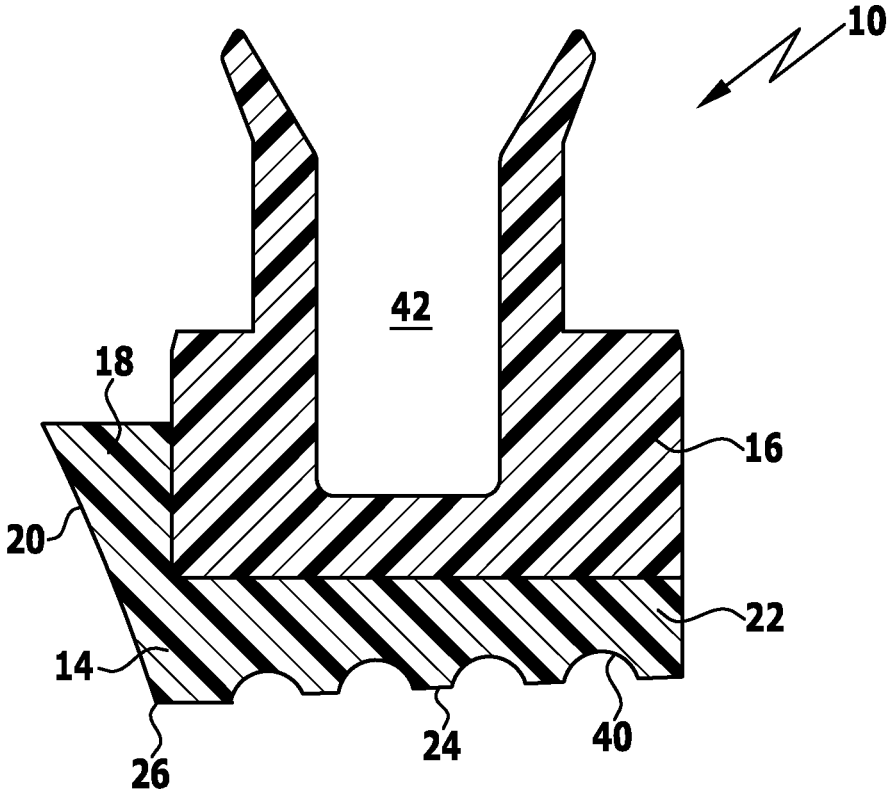
FIG. 1 shows a first exemplary embodiment of a sealing element according to the invention.

FIG. 1 shows a first exemplary embodiment of a sealing element according to the invention, which is given the overall reference 10. The sealing element 10 is rotationally symmetrical in the form of a ring or a partial arc of a circle, wherein a cross-section along a plane containing the rotational axis is shown in FIG. 1.

Figure 2:
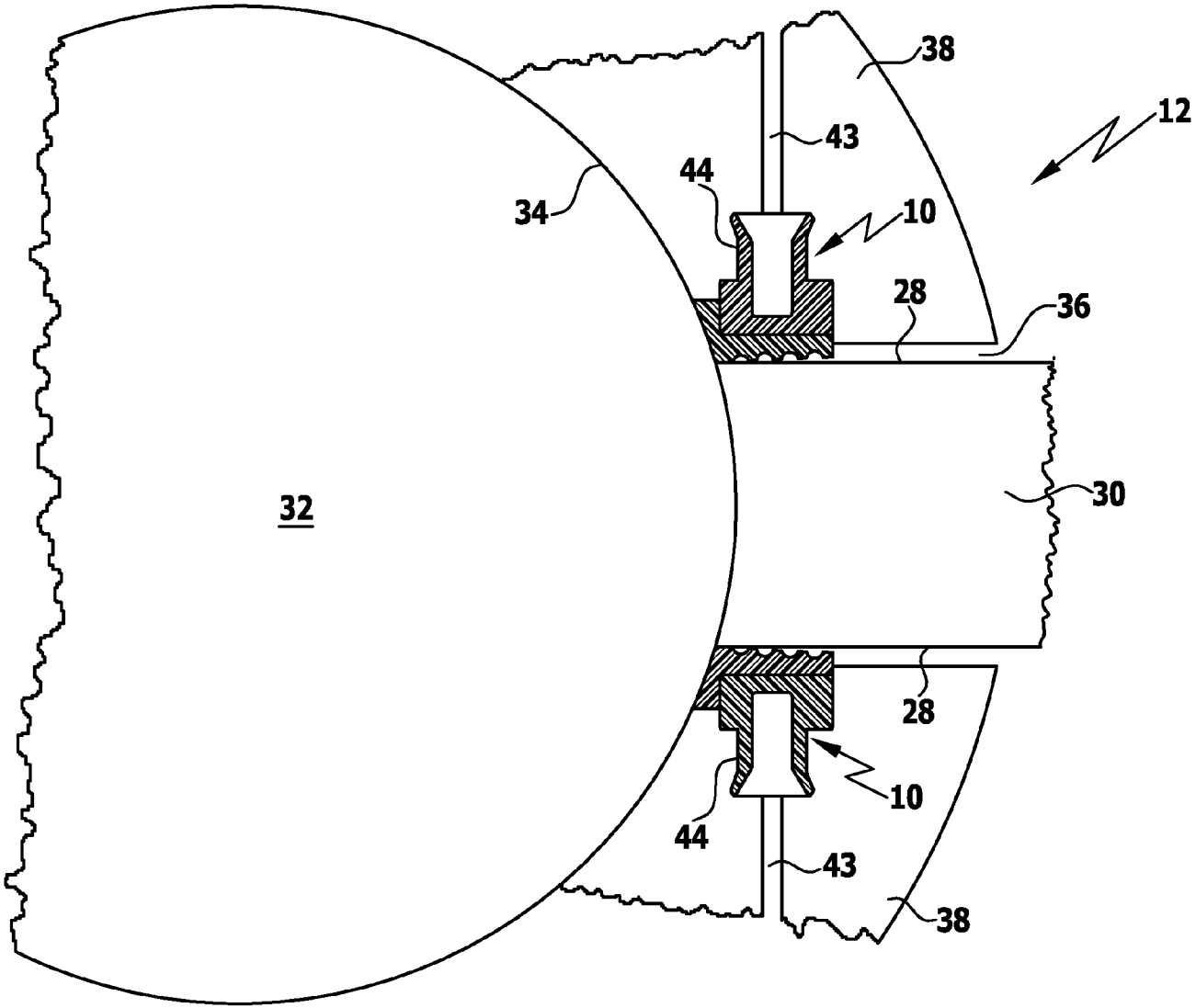
FIG. 2 shows a detail of a rotary piston machine according to the invention with two sealing elements according to FIG. 1.

FIG. 2 shows a detail of a rotary piston machine 1 according to the invention, which comprises two sealing elements 10 according to the invention shown in FIG. 1. The structure and function of such a rotary piston machine are described in detail in DE 10 2007 001 021 A1.

The sealing element 10 comprises a first sealing part 14 and a second sealing part 16, which are both rotationally symmetrical relative to the rotational axis. The first sealing part 14 forms a dynamic region and the second sealing part 16 forms a static region of the two-part sealing element 10.

The first sealing part 14 is formed from a non-elastomeric fluoropolymer (e.g., PTFE or a melt processable TFE copolymer) and the second sealing part 16 is formed from an elastomeric material (e.g., an elastomeric polyurethane). The two sealing parts 14 and 16 are connected to one another in material-uniting manner, e.g. by fusion of the second sealing part 16 onto the first sealing part 14. However, the sealing element 10 can also be produced by co-extrusion of the two sealing parts 14 and 16.

The first sealing part 14 comprises a radial region 18 with a radial sealing face 20 and an axial region 22 with an axial sealing face 24. The radial sealing face 20 and the axial sealing face 24 meet one another along an edge 26, wherein the edge 26 is ring-shaped or arc-shaped. The second sealing part 16 is offset radially inwards relative to the radial region 18 and offset axially relative to the axial region 22.

In the rotary piston machine 12 the axial sealing faces 24 of the two sealing elements 10 are respectively oriented towards the opposing surfaces 28 of a lever 30. The lever 30 is a substantially circular drive disc, which is fixedly connected to a piston 32 on one side and to a rotary body (e.g., a shaft—not shown in FIG. 2) on the other side. The piston 32 is movably disposed in an annular channel 34, and the lever 30 is rotatably guided around the rotational axis in an annular gap 36 incorporated into the wall 38 of the annular channel 32.

The axial sealing face 24 of the first sealing part 14 is inclined at an angle of approximately 2° relative to a plane perpendicular to the rotational axis that corresponds to the surface 28 of the lever 30. Therefore, in the pressureless state of the sealing element 10 the axial sealing face 24 only abuts against the surface 28 in the region of the edge 26, which is sufficient for a seal against the hydraulic fluid located in the annular channel 34 in the static, i.e., pressureless, state. The axial sealing face 24 has multiple grooves 40, as a result of which the effective sealing surface can be reduced or can be distributed over a larger region in the radial direction.

The radial sealing face 20 of the first sealing part 14 is faces towards the interior of the annular channel 34 and abuts against the piston 32 in sections. The radial sealing face 20 thus contributes towards the sealing of the side of the piston 32 subjected to pressure against the side not subjected to pressure.

A channel 42, which extends along the entire periphery of the sealing element 10, is formed in the second sealing part 16. The channel 42 is closed towards the first sealing part 14 and is continuously open to the outside. In the dynamic state of the rotary piston machine 12 the channel 42 is supplied with pressurised hydraulic fluid by means of one or more supply pipes 43 in the wall 38. This results in a transmission of force to the axial region 22 of the first sealing part 14 (and to a lesser degree also to the radial region 18), so that the inclination of the axial sealing face 24 increasingly disappears and finally the entire axial sealing face 24 abuts against the surface 28 of the lever 30. The sealing effect of the sealing element 10 according to the invention thus increases in keeping with the pressure of the hydraulic fluid to be sealed in the annular channel 34 of the rotary piston machine 12.

As a result of its structure as well as the selection of materials, the sealing element 10 according to the invention allows an optimum sealing effect both in the static state (because of the prestress as a result of the elastic material of the second sealing part 16) and in the dynamic state (as a result of subjecting the channel 42 to pressure).

The sealing elements 10 are received in corresponding recesses 44 of the wall 38 of the annular channel 34 and are held there in shape-locking and/or force-locking manner. The sealing elements 10 are preferably adhered into the recesses 44, e.g., by means of a polyurethane adhesive.

Figure 3:
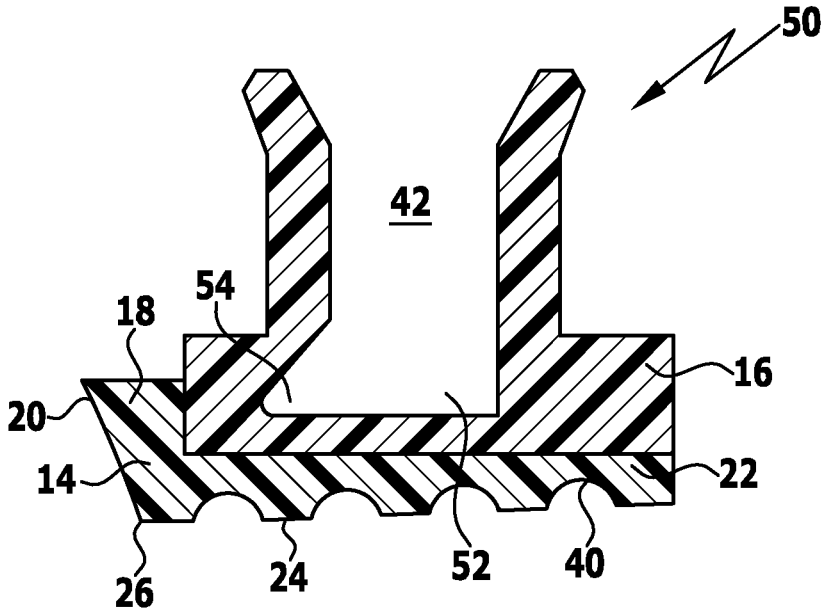
FIG. 3 shows a second exemplary embodiment of a sealing element according to the invention.

FIG. 3 shows a second exemplary embodiment of a sealing element according to the invention, which is given the overall reference 50. Except for the differences described below, the sealing element 50 is constructed correspondingly to the sealing element 10 of the first exemplary embodiment, wherein the same or corresponding elements are respectively provided with the same reference numbers.

Compared to the sealing element 10, the radial sealing face 20 of the sealing element 50 has a smaller extent in the axial direction, i.e. the radial sealing face 20 is smaller. To nevertheless also assure a sufficient sealing effect in this region in the dynamic state, the channel 42 in the second sealing part 16 is undercut, i.e., the base region 52 of the channel 42 has a widening 54 in the radial direction to the outside. As a result, less elastomeric material is located between the channel 42 and the radial region 18 of the first sealing part 14, so that the subjection of the channel 42 to pressure has a greater influence on the increase in contact pressure of the radial sealing face 20 on the piston 32.

Figure 4:
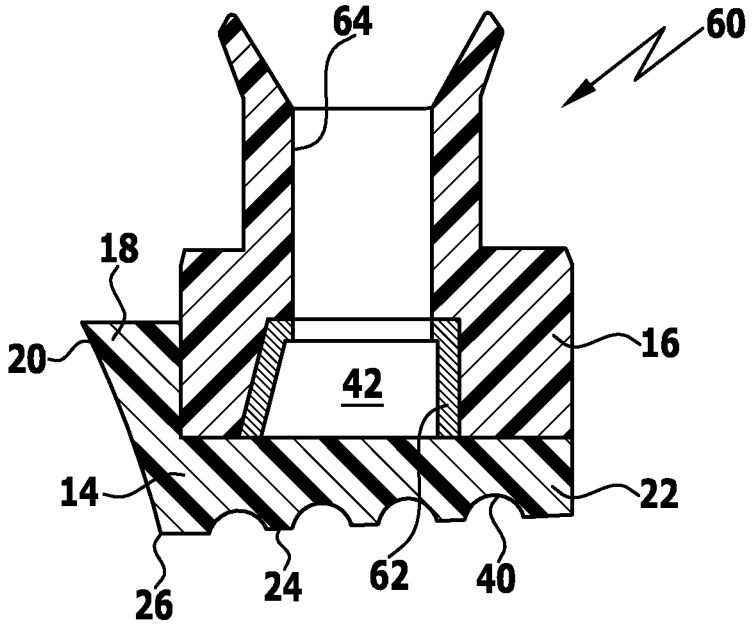
FIG. 4 shows a third exemplary embodiment of a sealing element according to the invention.

FIG. 4 shows a third exemplary embodiment of a sealing element according to the invention, which is given the overall reference 60. The sealing element 60 also corresponds to the sealing element 10 according to the first exemplary embodiment except for the differences described below.

In the case of the sealing element 60 the channel 42 formed in the second sealing part 16 is open towards the first sealing part 14 and is delimited by a steel profile 62, which is trough-shaped in cross-section and is likewise open towards the first sealing part 14. In this variant the pressure of the hydraulic fluid introduced into the channel 42 is transferred directly onto the axial region 22 of the first sealing part 14. In this case, the steel profile 62 prevents a deformation of the elastic material of the second sealing part 16 as a result of the pressure of the hydraulic fluid. Moreover, the steel profile 62 protects the channel 42 against damage during fusion of the second sealing part 16 onto the first sealing part 14.

In the case of the sealing element 60 the channel 42 is closed to the outside along the periphery of the second sealing part 16. The introduction of the fluid into the channel 42 occurs through one or more bores 64, which run in the axial direction through the second sealing part 16 as well as the steel profile 62.

That which is claimed:

1. A sealing element in a hydraulic rotary piston machine for sealing a lever which is guided in an annular gap and is rotatable around a rotational axis, the lever being attached to a piston which is movably disposed in an annular channel coaxially surrounding the annular gap, wherein the sealing element is rotationally symmetrical relative to the rotational axis, wherein the sealing element comprises a first sealing part forming a dynamic region and a second sealing part forming a static region, wherein the dynamic region has an axial sealing face being directed towards and delimiting the annular gap, and a radial sealing face being directed towards and delimiting the annular channel;

wherein the axial sealing face and the radial sealing face meet one another along a ring-shaped or arc-shaped edge;

wherein the second sealing part is offset radially inwards relative to the radial sealing face and offset axially relative to the axial sealing face; and wherein the static region serves to fix the sealing element to the rotary piston machine, and wherein there is formed in the static region a channel positioned to receive a fluid, such that the fluid exerts a force onto the axial sealing face.

2. The sealing element according to claim 1, wherein the first sealing part is formed from a non-elastomeric fluoropolymer.

3. The sealing element according to claim 2, wherein the non-elastomeric fluoropolymer consists of a homopolymeric PTFE or a copolymer of tetrafluoroethylene with at least one comonomer.

4. The sealing element according to claim 3, wherein the fluoropolymer contains one or more fillers.

5. The sealing element according to claim 1, wherein the second sealing part is formed from an elastomeric material.

6. The sealing element according to claim 5, wherein the elastomeric material comprises a thermoplastic elastomer.

7. The sealing element according to claim 6, wherein the thermoplastic elastomer is an elastomeric polyurethane.

8. The sealing element according to claim 1, wherein the axial sealing face of the first sealing part is inclined in relation to a plane perpendicular to the rotational axis.

9. The sealing element according to claim 1, wherein the axial sealing face has one or more grooves.

10. The sealing element according to claim 1, wherein the first and the second sealing part are connected to one another in material-uniting manner.

11. The sealing element according to claim 10, wherein the second sealing part is fused onto the first sealing part.

12. The sealing element according to claim 10, wherein the first and second sealing parts are produced by co-extrusion of a non-elastomeric fluoropolymer and an elastomeric material.

13. The sealing element according to claim 1, wherein the channel formed in the second sealing part is closed towards the first sealing part.

14. The sealing element according to claim 1, wherein the channel formed in the second sealing part is open towards the first sealing part.

15. The sealing element according to claim 14, wherein the channel is delimited by a metal profile, which is trough-shaped in cross-section and is open towards the first sealing part.

16. A rotary piston machine with at least one annular channel, which is curved along an at least partial arc of a circle and in which a piston is movably disposed, and with an annular gap being incorporated into the wall of the annular channel in which a lever is guided, which is rotatable around a rotational axis coaxial to the annular channel, wherein the rotary piston machine comprises at least two sealing elements according to claim 1, which are received in corresponding recesses of the wall of the annular channel, so that the axial sealing faces of the two sealing elements are respectively oriented towards opposite surfaces of the lever, and the radial sealing faces of the sealing elements are oriented towards the interior of the annular channel, and a section of the radial sealing faces abuts against the piston.

17. The rotary piston machine according to claim 16, wherein the sealing elements are adhered into the recesses.

* * * * *

UNITED STATES PATENT AND TRADEMARK OFFICE

CERTIFICATE OF CORRECTION

PATENT NO. : 9,074,475 B2
APPLICATION NO. : 13/961333
DATED : July 7, 2015
INVENTOR(S) : Heinz Raubacher et al.

It is certified that error appears in the above-identified patent and that said Letters Patent is hereby corrected as shown below:

On the title page, under items (71), (72) and (73), the applicant's city of residence has been typed incorrectly. The correct spelling is Vaihigen (DE) *not* Valhingen (DE).

(71) Applicant: Heinz Raubacher, Vaihingen (DE)

(72) Inventors: Heinz Raubacher, Vaihingen (DE);

(73) Assignee: Heinz Raubacher, Vaihingen (DE)

Additionally, on Page 1, under the heading "Foreign Application Priority Data," the last digit of the foreign priority application number was omitted, it should appear as follows:

Foreign Application Priority Data

Feb. 10, 2011 (DE) . . . . . 10 2011 003 934.1

Signed and Sealed this
Fifteenth Day of December, 2015

Michelle K. Lee

Michelle K. Lee
*Director of the United States Patent and Trademark Office*